US009707144B1

(12) United States Patent
Stewart

(10) Patent No.: US 9,707,144 B1
(45) Date of Patent: Jul. 18, 2017

(54) PATIENT ROTATION DEVICE

(71) Applicant: Bryan T. Stewart, Apopka, FL (US)

(72) Inventor: Bryan T. Stewart, Apopka, FL (US)

( * ) Notice: Subject to any disclaimer, the term of this patent is extended or adjusted under 35 U.S.C. 154(b) by 1154 days.

(21) Appl. No.: 13/723,903

(22) Filed: Dec. 21, 2012

(51) Int. Cl.
*A61G 15/00* (2006.01)
*A61G 99/00* (2006.01)

(52) U.S. Cl.
CPC ..... *A61G 99/00* (2013.01)

(58) Field of Classification Search
CPC . A61G 99/00; A61G 7/10; A61G 7/00; A61G 7/1013; A61G 7/1015; A61G 7/1019; A61G 7/1042; A61G 7/1049; A61G 7/1053; A61G 7/1055; A61G 7/1057; A61G 7/001; A61G 7/1001; A61G 7/1003; A61G 7/1005; A61G 7/1007; A61G 7/1009; A61G 7/1011; A61G 7/1017; A61G 7/1038; A61G 7/104; A61G 7/1059; A61G 7/1061; A47K 3/12; A47K 3/122; A47K 3/125; A47K 3/127
See application file for complete search history.

(56) References Cited

U.S. PATENT DOCUMENTS 2,294,164 A * 8/1942 Eberle ..... A47K 3/122 4/561.1
3,394,933 A * 7/1968 Benoit ..... A61G 7/1019 254/4 R
D352,590 S 11/1994 Hodges
6,241,215 B1 * 6/2001 Gersemsky ..... A61G 7/1015 254/342
6,393,636 B1 5/2002 Wheeler

* cited by examiner

*Primary Examiner* — Victoria J Hicks
(74) *Attorney, Agent, or Firm* — Stevenson IP, LLC

(57) ABSTRACT

A patient rotation device including a leverage bar member having a removable padded housing, a first cross-bar member attached to a top end of the leverage bar member, and at least a second cross-bar member disposed on a rear side of the leverage bar member at the concave portion, wherein the leverage bar member is moved by a winch mechanism attached thereto by an upper hook on the end of a first cable, and a lower hook on the end of a second cable attached to an underside of a bed frame.

6 Claims, 4 Drawing Sheets

PATIENT ROTATION DEVICE

BACKGROUND OF THE INVENTION

Various types of rotational devices for bed ridden patients are known in the prior art. However, what is needed is a patient rotation device to turn a bed ridden patient onto the patient's side to properly position the patient for cleaning, medical procedures, and patient comfort by providing a leverage bar member partially covered by a padded housing that is disposed underneath a patient's back, at least two cross-bar members to brace and to support the leverage bar member, and a motorized winch mechanism with opposing cables, each having hook thereon, one of which is attached to an upper one of the cross-bar members and the other of which is attached to an underside of a bed frame to move and rotate the leverage bar member.

FIELD OF THE INVENTION

The present invention relates to devices for repositioning a bedfast patient, and more particularly, to a patient rotation device which includes a leverage bar member disposed underneath a patient's back, at least two cross-bar members to brace and to support the leverage bar member, and a motorized winch mechanism that transforms the leverage bar member from an initial position wherein the upper portion of the leverage bar member is disposed perpendicular to a top side of a mattress disposed atop the frame and the lower portion of the leverage bar member is disposed parallel to the top side of the mattress to a rotated position wherein the lower portion of the leverage bar member is disposed at an angle from the top side of the mattress.

SUMMARY OF THE INVENTION

The general purpose of the present patient rotation device, described subsequently in greater detail, is to provide a patient rotation device which has many novel features that result in a patient rotation device which is not anticipated, rendered obvious, suggested, or even implied by prior art, either alone or in combination thereof.

To accomplish this, the present patient rotation device is designed to reposition a bedridden patient to provide access to the patient for cleaning and medical procedures while the patient in positioned on his side. The device also permits repositioning the patient onto his side to provide a change in position, which can also make the patient more comfortable. The device includes an L-shaped leverage bar member; a first cross-bar member perpendicularly attached to a top end thereof; a second cross-bar member perpendicularly attached to a rear side of the leverage bar member at concave portion thereof; and a third cross-bar member attached to the rear side proximal to a bottom end of a leverage bar member upper portion. An aperture is centrally disposed through the first cross-bar member. The cross-members are approximately 3 inches wide each and are configured to provide stability to avoid the twisting of the leverage bar members while in position underneath a patient.

A first cable partially disposed within a winch box is in operational communication with a motorized winch mechanism. A first cable upper hook engages the aperture of the first cross-bar member. A lower hook, disposed on a distal end of a second cable attached to the winch mechanism, attaches to an underside of a bed frame.

Upon the activation of the motorized winch mechanism, the first cable operationally engages the first cross-bar member which, in turn, moves and transforms the leverage bar member from an initial position wherein the upper portion of the leverage bar member is disposed perpendicular to a top side of a mattress disposed atop the frame and the lower portion of the leverage bar member is disposed parallel to the top side of the mattress to a rotated position wherein the lower portion of the leverage bar member is disposed at an angle from the top side of the mattress. The winch box is lightweight to accommodate portability.

At least one L-shaped support arm is provided to add an extra support structure for an obese patient, a patient with a large wound, or for a sensitive patient's added comfort. The support arm is disposed in a position parallel to the leverage bar member with the curved portion disposed atop the second cross-bar member as well as the third cross-bar member, when provided, and the top portion disposed adjacent to a rearward side of the first cross-bar member. If more than one support arm is employed, the support arms can be disposed on opposite sides or on the same side of the leverage bar member. The support arm is placed underneath a patient after the leverage bar member is in place underneath the patient in the event additional support for the patient is required. The support arm is held into place against the first, second, and third cross-bar members by the weight of the patient. A padded housing is provided also to removably receive each of at a lower portion of the leverage bar member and at least the bottom portion of the support arm.

The leverage bar member has a width of approximately 3 inches. The overall height of the device is approximately 15 inches; however, the upper portion can have a length up to an additional 12 inches to accommodate a patient's rotatability and the proximity of the bed frame to the upper portion. The lower portion can be formed to be detachable for removal away from the patient and to accommodate storage.

Thus has been broadly outlined the more important features of the present patient rotation device so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
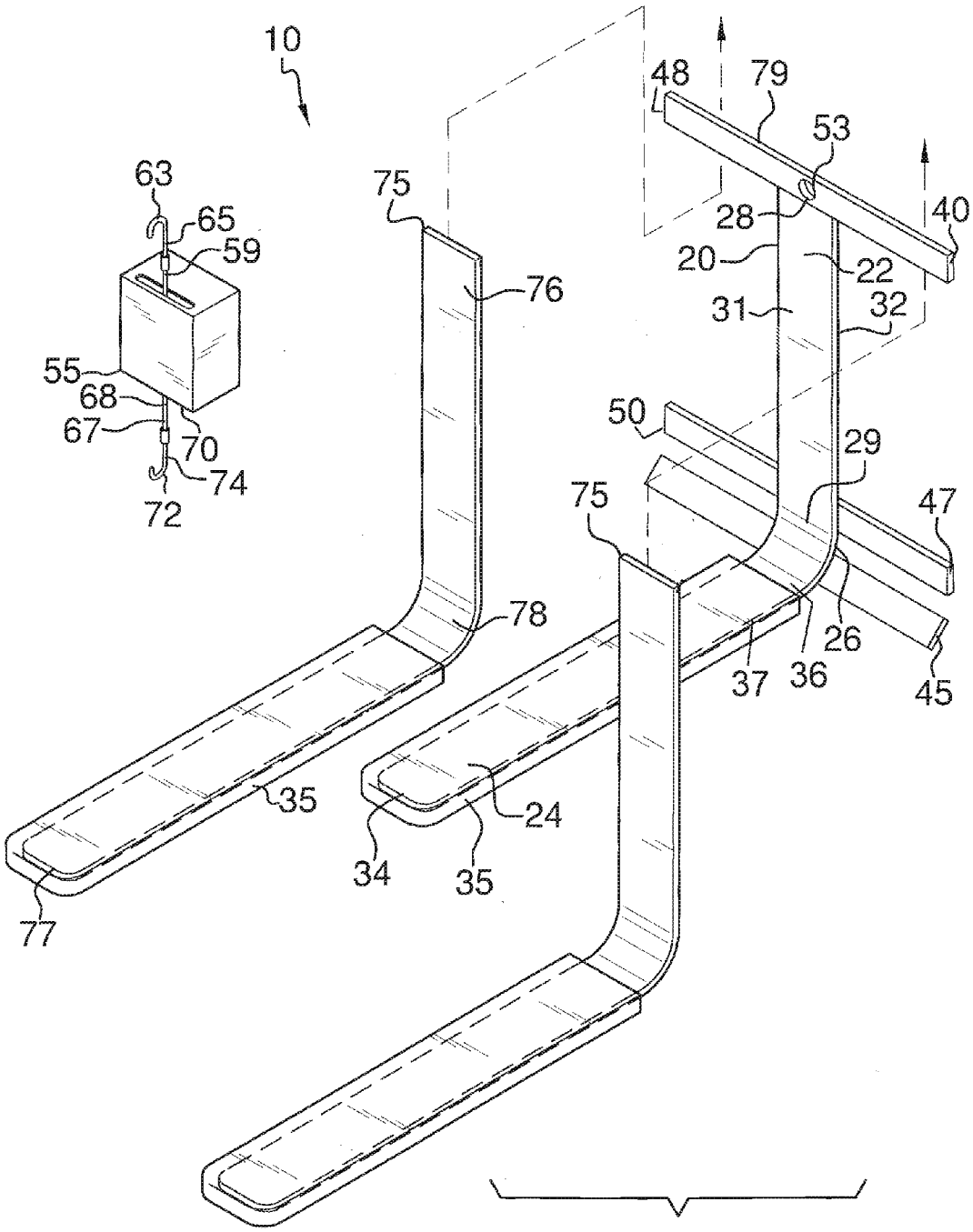
FIG. 1 is a perspective view.
Figure 2:
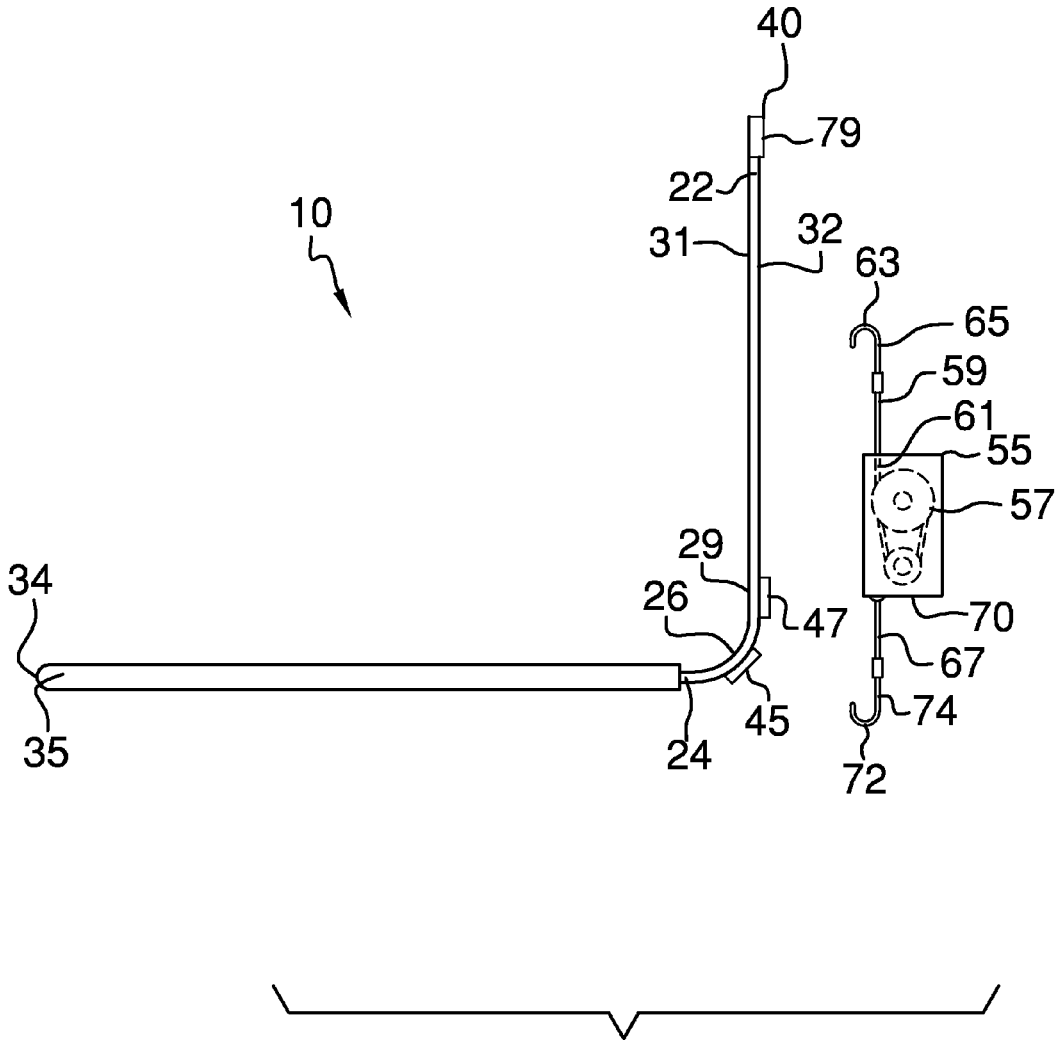
FIG. 2 is a side elevation view.
Figure 3:
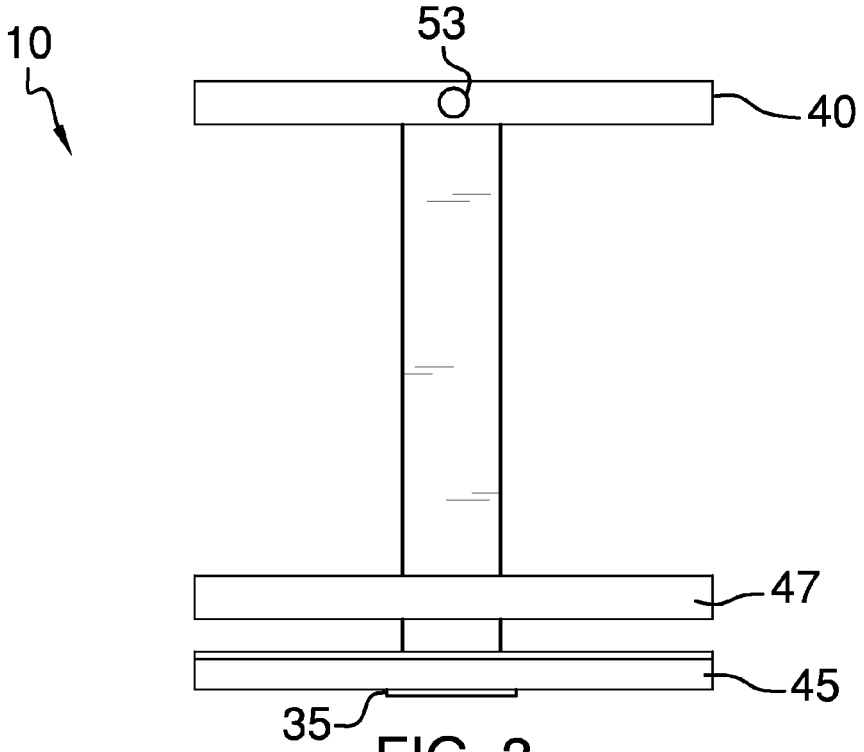
FIG. 3 is a rear elevation view.
Figure 4:
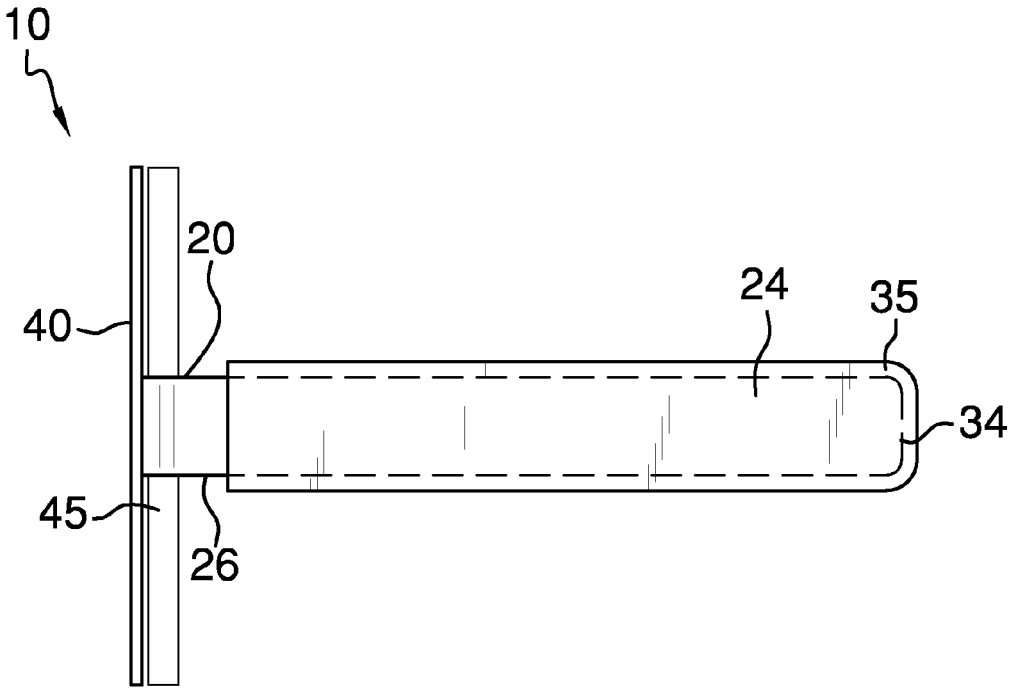
FIG. 4 is a top plan view.
Figure 5A:
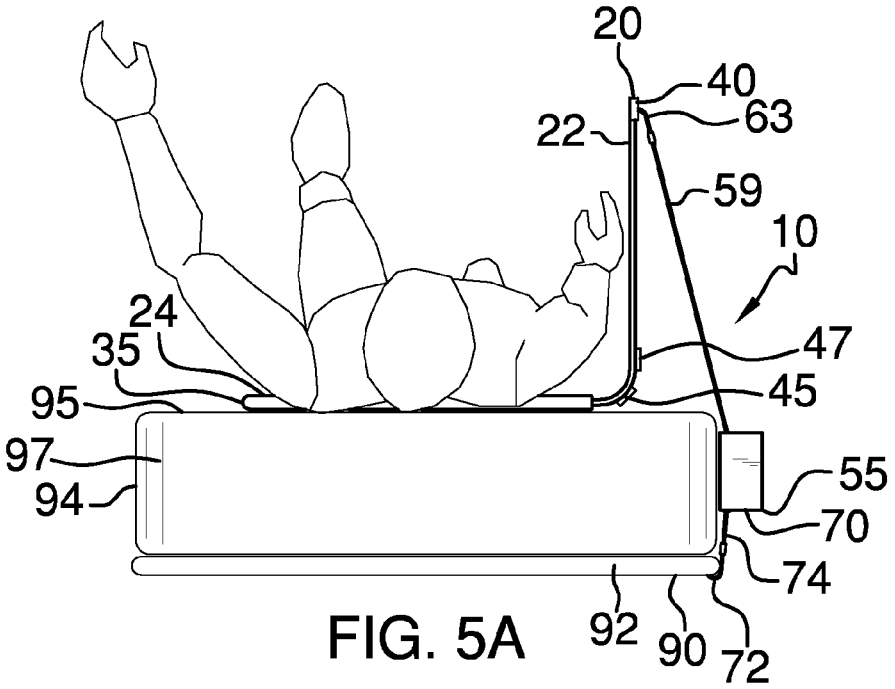
FIG. 5A is an in-use view illustrating the device in an initial position with a patient in a supine position.
Figure 5B:
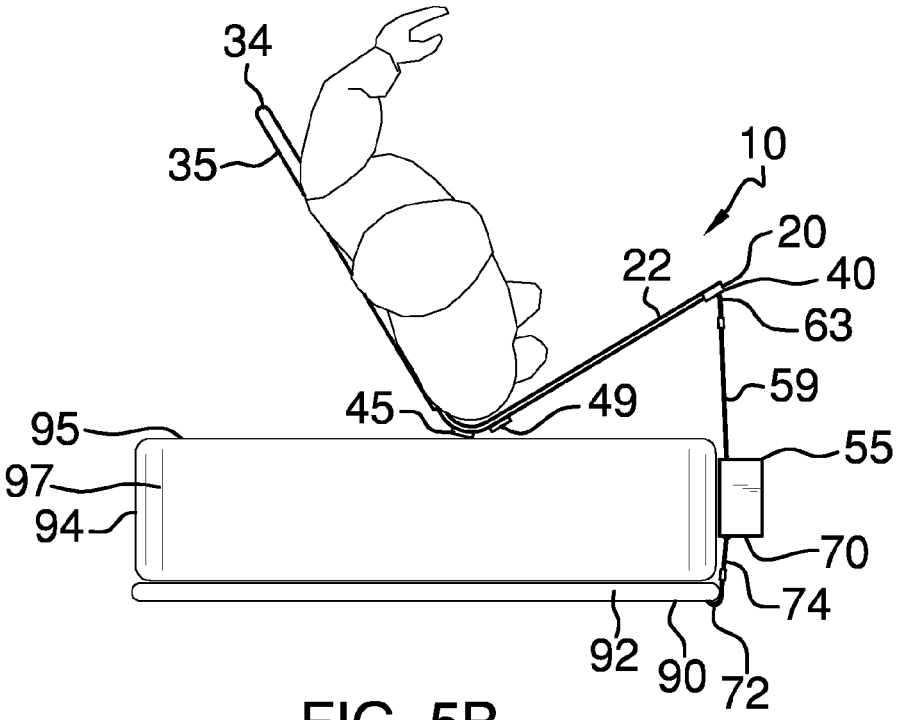
FIG. 5B is an in-use view illustrating the device in a moved position with the patient in a rotated side position.

With reference now to the drawings, and in particular FIGS. 1 through 5B thereof, example of the instant patient rotation device employing the principles and concepts of the present patient rotation device and generally designated by the reference number 10 will be described.

Referring to FIGS. 1 through 5B a preferred embodiment of the present patient rotation device 10 is illustrated. The patient rotation device 10 includes a single L-shaped leverage bar member 20. The L-shaped leverage bar member 20 has an upper portion 22, a lower portion 24, and a concave portion 26 disposed between the upper portion 22 and the lower portion 24. The upper portion 22 has a top end 28 and a bottom end 29. Each of the upper portion 22 and the concave portion 26 has a front side 31 and a rear side 32. Each of the front side 31 and the rear side 32 of the upper portion 22 is flat. The lower portion 24 has an outer end 34, a flat upper side 36, and a flat lower side 37. At least one padded housing 35 is provided to pad the L-shaped leverage bar member lower portion 24 thereby providing additional comfort for a patient. The at least one padded housing 35 removably receives at least the lower portion 24 of the L-shaped leverage bar member 20 therein. The L-shaped leverage bar member 20 is configured to support a patient lying in a supine position on the lower portion 24.

A parallelepiped first cross-bar member 40 is attached to the top end of the leverage bar member 20 in a position perpendicular to the L-shaped leverage bar member 20 upper portion 22. A parallelepiped second cross-bar member 45 is attached directly to the rear side 32 at the concave portion 26 in a position perpendicular to the lower portion 24. A parallelepiped third cross-bar member 47 is attached directly to the rear side 32 proximal to the bottom end 29 of the upper portion 22 in a position perpendicular to the upper portion 22. The L-shaped leverage bar member 20 is centrally disposed with respect to the parallelepiped first cross-bar member 40, the parallelepiped second cross-bar member 45, and the parallelepiped third cross-bar member 47. An aperture 53 is centrally disposed through the parallelepiped first cross-bar member 40. Each of the parallelepiped first cross-bar member 40 and the parallelepiped second cross-bar member 45 has a pair of free outer ends 48 and the parallelepiped third cross-bar member 47 has a pair of free external ends 50.

A winch box 55, which has a motorized winch mechanism 57 disposed therein, is provided. A first cable 59, which has a lower end 61 disposed within the winch box 55, is in operational communication with the winch mechanism 57. An upper hook 63 is disposed on an upper end 65 of the first cable 59. The upper hook 63 is configured to engage the aperture 53 disposed in the first cross-bar member 40. A second cable 67 which has a proximal end 68 attached to a bottom side 70 of the winch box 55 is included in the present device 10. A lower hook 72 is disposed on a distal end 74 of the second cable 67. The lower hook 72 is configured to attach to an underside 90 of a frame 92 of a bed 94 to secure the winch box 55 proximal to the bed 94.

At least one L-shaped support arm 75 is provided to add an extra support structure for an obese patient, a patient with a large wound, or for a sensitive patient's added comfort. The L-shaped support arm 75 has a top portion 76, a bottom portion 77, and a concave curved portion 78 disposed therebetween. The L-shaped support arm 75 is disposed in a position parallel to the L-shaped leverage bar member 20 with the concave curved portion 78 disposed atop the parallelepiped second cross-bar member 45 as well as the parallelepiped third cross-bar member 47, when provided, and the top portion 76 disposed adjacent to a rearward side 79 of the parallelepiped first cross-bar member 40. The L-shaped support arm 75 is configured to be used either individually or in plurality. If more than one L-shaped support arm 75 is employed, the L-shaped support arms 75 can be disposed on opposite sides or on the same side of the L-shaped leverage bar member 20. The L-shaped support arm 75 is held into place against the parallelepiped first, second, and third cross-bar members 40, 45, 47 by the weight of the patient. As is the L-shaped leverage bar member 20 lower portion 24, one of the at least one padded housing 35 removably receives at least the bottom portion 77 of the L-shaped support arm 75 therein.

Upon the activation of the motorized winch mechanism 57, the first cable 59 operationally engages the parallelepiped first cross-bar member 40. Upon the operational engagement of the parallelepiped first cross-bar member 40 by the first cable 59, the L-shaped leverage bar member 20 is moved and transforms from an initial position wherein the upper portion 22 of the L-shaped leverage bar member 20 is disposed perpendicular to a top side 95 of a mattress 97 disposed atop the frame 92 and the lower portion 24 of the L-shaped leverage bar member 20 is disposed parallel to the top side 95 of the mattress 97 to a rotated position wherein the lower portion 24 of the L-shaped leverage bar member 20 is disposed at an angle from the top side 95 of the mattress 97. The L-shaped support arm 75 is added underneath the patient after the L-shaped leverage bar member 20 is placed underneath the patient for added patient support.

What is claimed is:

1. A patient rotation device comprising:

an L-shaped leverage bar member having an upper portion, a lower portion, and a concave portion disposed between the upper portion and the lower portion;

a top end and a bottom end of the upper portion;

a front side and a rear side of each of the upper portion and the concave portion, each of the front side and the rear side of the upper portion being flat;

an outer end, a flat upper side, and a flat lower side of the lower portion;

a parallelepiped first cross-bar member attached to the top end of the L-shaped leverage bar member in a position perpendicular to the L-shaped leverage bar member upper portion;

a parallelepiped second cross-bar member attached directly to the rear side on the concave portion in a position perpendicular to the lower portion, each of the parallelepiped first cross-bar member and the parallelepiped second cross-bar member having a pair of free outer ends;

wherein the L-shaped leverage bar member is centrally disposed with respect to the parallelepiped first and second cross-bar members;

an aperture centrally disposed through the parallelepiped first cross-bar member;

a winch box having a motorized winch mechanism disposed therein;

a first cable having a lower end disposed within the winch box, the first cable in operational communication with the winch mechanism;

an upper hook disposed on an upper end of the first cable;

wherein the upper hook is configured to engage the aperture;

a second cable having a proximal end attached to a bottom side of the winch box;

a lower hook disposed on a distal end of the second cable; and wherein the L-shaped leverage bar member is configured to support a person lying in a supine position on the lower portion thereof.

2. The patient rotation device of claim 1 further comprising a parallelepiped third cross-bar member attached to the rear side proximal to the bottom end of the upper portion in a position perpendicular to the L-shaped leverage bar member upper portion, the parallelepiped third cross-bar member having a pair of free external ends.

3. The patient rotation device of claim 2 further comprising at least one L-shaped support arm having a top portion, a bottom portion, and a concave curved portion disposed therebetween; and wherein the at least one L-shaped support arm is selectively disposed in a position parallel to the L-shaped leverage bar member with the concave curved portion disposed atop the parallelepiped second and third cross-bar members and the top portion of the at least one L-shaped support arm disposed adjacent to a rearward side of the parallelepiped first cross-bar member.

4. The patient rotation device of claim 1 further comprising at least one L-shaped support arm having a top portion, a bottom portion, and a concave curved portion disposed therebetween; and wherein the at least one L-shaped support arm is selectively disposed in a position parallel to the L-shaped leverage bar member with the concave curved portion disposed atop the parallelepiped second cross-bar member and the top portion of the at least one L-shaped support arm disposed adjacent to a rearward side of the parallelepiped first cross-bar member.

5. The patient rotation device of claim 4 further comprising at least one padded housing, wherein one of the at least one padded housing removably receives at least the lower portion of the L-shaped leverage bar member, and further wherein one of the at least one padded housing removably receives at least the bottom portion of the at least one L-shaped support arm.

6. The patient rotation device of claim 1 further comprising at least one padded housing, wherein the at least one padded housing removably receives at least the lower portion of the L-shaped leverage bar member therein.

* * * * *